United States Patent [19]

Swin, Sr. et al.

[11] Patent Number: 4,748,900

[45] Date of Patent: Jun. 7, 1988

[54] DUCTED VENTILATOR

[75] Inventors: Richard E. Swin, Sr., Burr Ridge; Anwar A. Atalla, Willowbrook, both of Ill.

[73] Assignee: Tec-Air, Inc., Willow Springs, Ill.

[21] Appl. No.: 318,748

[22] Filed: Nov. 6, 1981

Related U.S. Application Data

[63] Continuation of Ser. No. 57,593, Jul. 16, 1979, abandoned.

[51] Int. Cl.[4] ..... F24F 7/02

[52] U.S. Cl. ..... 98/40.09; 98/40.07

[58] Field of Search ..... 98/400 L, 40 D, 43; 55/102; 362/92

[56] References Cited

U.S. PATENT DOCUMENTS 822,167 5/1906 Vaughn ..... 362/92

3,785,271 1/1974 Joy ..... 98/40 DL 3,846,072 11/1974 Patterson ..... 55/102

3,909,589 9/1975 Stone et al. ..... 98/40 DL

*Primary Examiner*—Henry A. Bennett

*Attorney, Agent, or Firm*—Wall and Roehrig

[57] ABSTRACT

A ducted air ventilator device having changeable lighting elements. A vaneless diffuser fan circulates air through the unit and cools the elements thereof. The device may be mounted directly to any standard electrical junction box or directly to any standard electrical socket. Alternatively, the device may be mounted to a mounting plate having plug type electrical sockets which is secured to a standard electrical junction box and facilitates rapid installation thereof, or the device having a split electrical socket which is secured to a standard electrical junction box. Either the fan or the light may be operated individually or both may be operated simultaneously. The device may be operated as either a ventilator exhausting air to the exterior of the room and the like or a circulation device circulating air in the room.

15 Claims, 4 Drawing Sheets

DUCTED VENTILATOR

This is a continuation of application Ser. No. 57,593, filed July 16, 1979 now abandoned.

BACKGROUND OF THE INVENTION

This invention relates in general to a ventilator, and, in particular, to a ducted ventilator. More specifically, but without restriction to the particular use which is shown and described, this invention relates to a ducted ventilating device having changeable lighting elements, and incorporates a vaneless diffuser fan which is the subject of the present inventor's co-pending application, Ser. No. 057559, entitled "Mixed Flow Fan with Rotating Vaneless Diffuser", filed concurrently herewith now U.S. Pat. No. 4,323,330.

Recreation rooms and cooking areas generally are well illuminated and well ventilated. It is a common practice to install hoods in the vicinity of and generally directly over cooking ranges. In addition, many kitchens have ventilating fans which serve to exhaust air from the kitchen and to draw fresh air therein from other parts of the building. In many instances, it is also desirable to illuminate and ventilate enclosed areas such as bathrooms and closets. For example, many bathrooms and powder rooms have ceiling mounted blowers or fan units, which are vented to the roof to remove steam and provide fresh air circulation.

Examples of techniques used to treat or purify room air include air freshening devices which sublimate and release pleasant odors into the air. A modification of this concept is disclosed in U.S. Pat. No. 4,035,451, issued to Tringali, wherein a battery operated unit incorporates a fan for inducing flow past a vaporizing air freshening product. However, this invention does not address the dual problem of lighting the same area, nor does it provide for the venting of exhausted air from the room in which it is installed. Conversely, U.S. Pat. No. 4,019,303 granted to Hetherington discloses a florescent light fixture which may be installed into any conventional threaded socket and additionally provides a flat mounting surface. However, there is no provision in this disclosure for ventilating, exhausting, or circulating the surrounding air.

With the advent of more modern building codes, the requirement for external venting of fans, blowers, and the like in certain locations has been eliminated. A ductless air treating device having changeable air treating and lighting elements which is the subject of the present inventor's co-pending application, Ser. No. 057,559, now U.S. Pat. No. 4,323,330 entitled "Ductless Air Treating Device with Illuminator" addresses the problem of providing a ductless air treating unit which will satisfy these codes. However, many applications continue to exist where it is desirable to externally exhaust the air present in a given area continuously while simultaneously drawing in fresh air. This invention addresses these multiple problems by combining the lighting, ventilating, and air treating features normally found in separate units into a simple, versatile, readily installable single unit.

The ducted ventilator unit disclosed herein offers several economic advantages. First, it is generally less expensive to provide a single ventilator and air circulating unit which performs all of the multiple functions mentioned above than it is to provide separate units performing the functions individually. A second economic advantage is realized by eliminating the costs of electrical wiring for multiple separate units. For example, the device may be installed in any existing electrical junction box, or, alternatively, it may be screwed into any standard threaded electrical socket. Thirdly, the lighting and other internal elements of the present invention are cooled by the air passing therethrough, which extends the functional lifetime of these elements. This cooling feature is particularly significant because present Underwriter Laboratory standards require that the temperature within the terminal junction box of such units be maintained at less than 60° C. It is well known to those skilled in the art that an enclosed lighting unit containing two standard incandescent bulbs will not pass this test. This invention brings the temperature within the air treating device within acceptable standards.

A second advantageous feature of this unit is its elimination of a condition known as stratification. Normally, the cooler air is near the floor while the hotter air is stratified near the ceiling of the room. The ventilating and air treating device, if ceiling mounted, recirculates the air within the room by drawing the colder air from the floor toward the ceiling. The result is a more even distribution of the heat therebetween. A reduction in the energy required to heat the room in the winter and to cool it in the summer is realized, which is translated into a monetary savings to the user.

Another problem overcome by this invention involves the theft of this type of unit from the job site during building construction. This problem is solved by providing only a mounting plate, which is unlikely to be stolen. After the building is completed and securely enclosed, the contractor may then mount the individual units to the mounting plate or, alternatively, to standard light sockets without fear of pilferage.

It is sometimes desirable to selectively operate either the ventilating fan, the light, or both simultaneously. By installing a ventilating device in a room and by running the circulating fan periodically, the freshness of air in the room and its contents may be maintained. Moreover, the unit provides for selective activation of a light as needed. The selective operation of the fan or the light is attained by the provision of a mounting plate having either a dual plug-type receptacle or a split electrical socket adapted to receive a corresponding split electrical contact which is fitted to the ventilating and air treating unit. The elements of the split electrical socket are the subject of the present inventor's co-pending application Ser. No. 057,559, entitled "Split Socket Assembly" filed concurrently herewith.

The mounting plates also function to isolate heat generated by the device from the adjacent mounting surface. By forming the plates from a thermally nonconductive material, for example, porcelain, heat from the unit is retained in the vicinity of the vaneless diffuser fan which exhausts it through the exhaust duct. This feature is important in light of the recent trend of homeowners toward adding large quantities of insulating material to their walls and ceilings. The insulating material may cause excessive heat buildup in the vicinity of electrical junction boxes or devices and create a fire hazard. The mounting plates disclosed herein eliminate this problem.

SUMMARY OF THE INVENTION

It is, therefore, an object of the present invention to improve ventilators.

Another object of this invention is to improve ducted ventilators.

A further object of the invention is to incorporate changeable lighting elements in a ducted ventilator.

Still another object of the present invention is to provide a low cost ducted ventilator which can be readily installed in an existing light socket or standard junction box.

A further object of the present invention is to incorporate a changeable lighting element in a low cost and readily installable ducted ventilator.

Yet another object of the present invention is to prevent the theft of ventilators from construction job sites.

A still further object of the present invention is to selectively ventilate or circulate air or, alternatively, to provide illumination separately or simultaneously with a single ducted ventilator.

Another object of the present invention is to mount the ventilator to a mounting plate which isolates heat generated by the device from the mounting surface.

These and other objects are attained in accordance with the present invention wherein there is provided a ducted air ventilator having changeable lighting elements. A vaneless diffuser fan circulates air through the unit and cools the elements thereof. The device may be mounted directly to any standard electrical junction box or directly to any standard electrical socket. Alternatively, the device may be mounted to a mounting plate having plug-type electrical sockets which is secured to a standard electrical junction box or the electrical sockets are secured thereto. Either the fan or the light may be operated individually or both may be operated simultaneously. The device of the invention is capable of both acting as a ventilator to direct air to the exterior of a room or the like or, alternatively, to circulate air in a room or other closed environment.

DESCRIPTION OF THE DRAWINGS

Further objects of the invention, together with additional features contributing thereto and advantages accruing therefrom, will be apparent from the following description of several embodiments of the invention when read in conjunction with the accompanying drawings, wherein.

DESCRIPTION OF THE PREFERRED EMBODIMENTS

Figure 1:
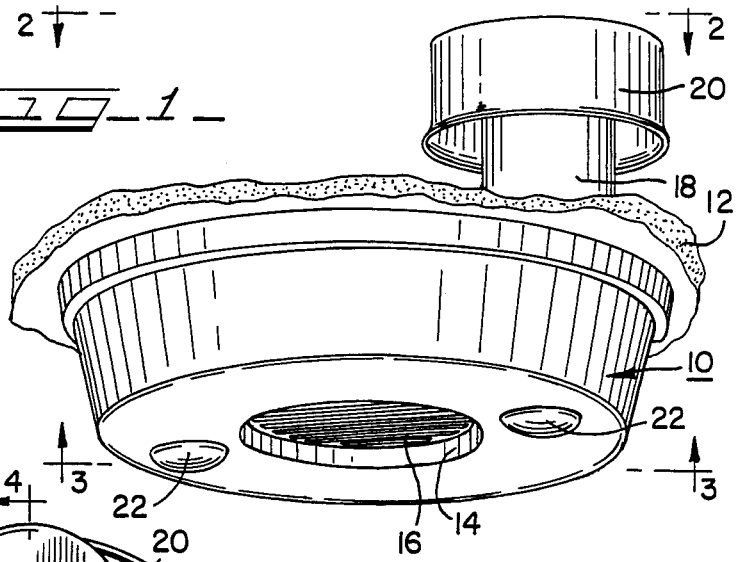
FIG. 1 is a perspective view of a ducted illuminating ventilator device of the invention, mounted on a surface.

Referring now to FIG. 1, there is shown a ducted ventilator having an ornamental cover or housing shown generally by the numeral 10 mounted to a surface 12. Although the illuminating ducted ventilator disclosed herein may be mounted to any surface and used with housings having numerous configurations and designs, for convenience of illlustration, the preferred embodiment is shown with reference to its use as a ceiling mounted illuminating ducted ventilating device. The housing 10 may be constructed from any durable, light-weight material, preferably plastic for ease of handling, and is removable to provide access to the internal components of the unit.

Housing 10 is formed with an air inlet 14 which is covered by an inlet grill 16. Inlet grill 16 may be constructed either as an integral part of the housing itself, or alternatively, may be a separate member removably secured to the housing for cleaning or replacement.

Figure 2:
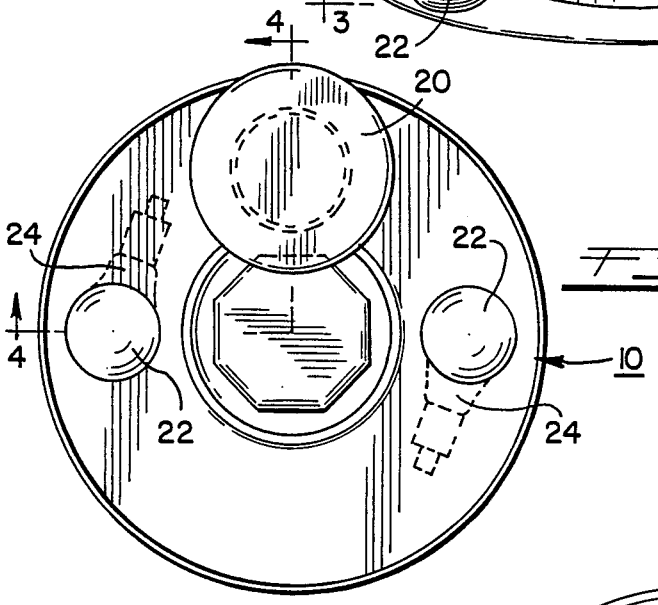
FIG. 2 is a top horizontal view of a ducted, illuminating ventilator taken in the direction of arrows 2—2 of FIG. 1.
Figure 3:
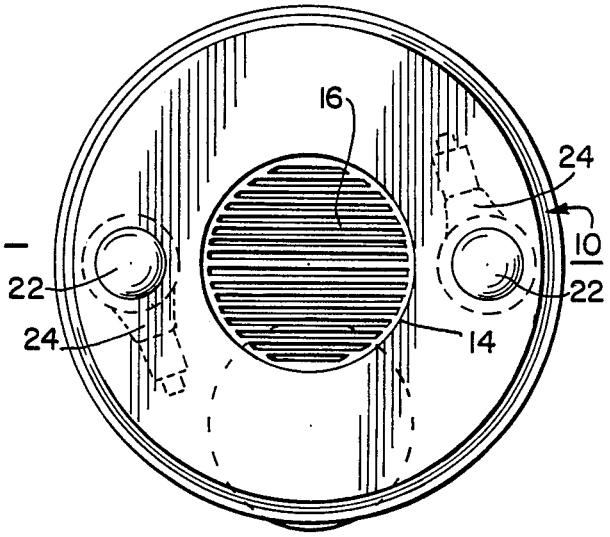
FIG. 3 is a bottom horizontal view of a ducted, illuminating ventilator taken in the direction of arrows 3—3 in FIG. 1.

An exhaust duct 18 is secured to the ceiling 12 and is connected to housing 10 and includes a protective cap 20 for exhausting air from the ventilating unit to an external area. As shown in FIG. 1 and illustrated in greater detail in FIGS. 2 and 3, housing 10 also is provided with a plurality of recessed areas 22 formed therein to accommodate lighting elements of various sizes and shapes. While in the embodiments shown, the lighting element is in the form of a pair of incandescent bulbs 24, it should be understood that the scope of the present invention is not limited thereto and covers other forms of illumination.

Figure 4:
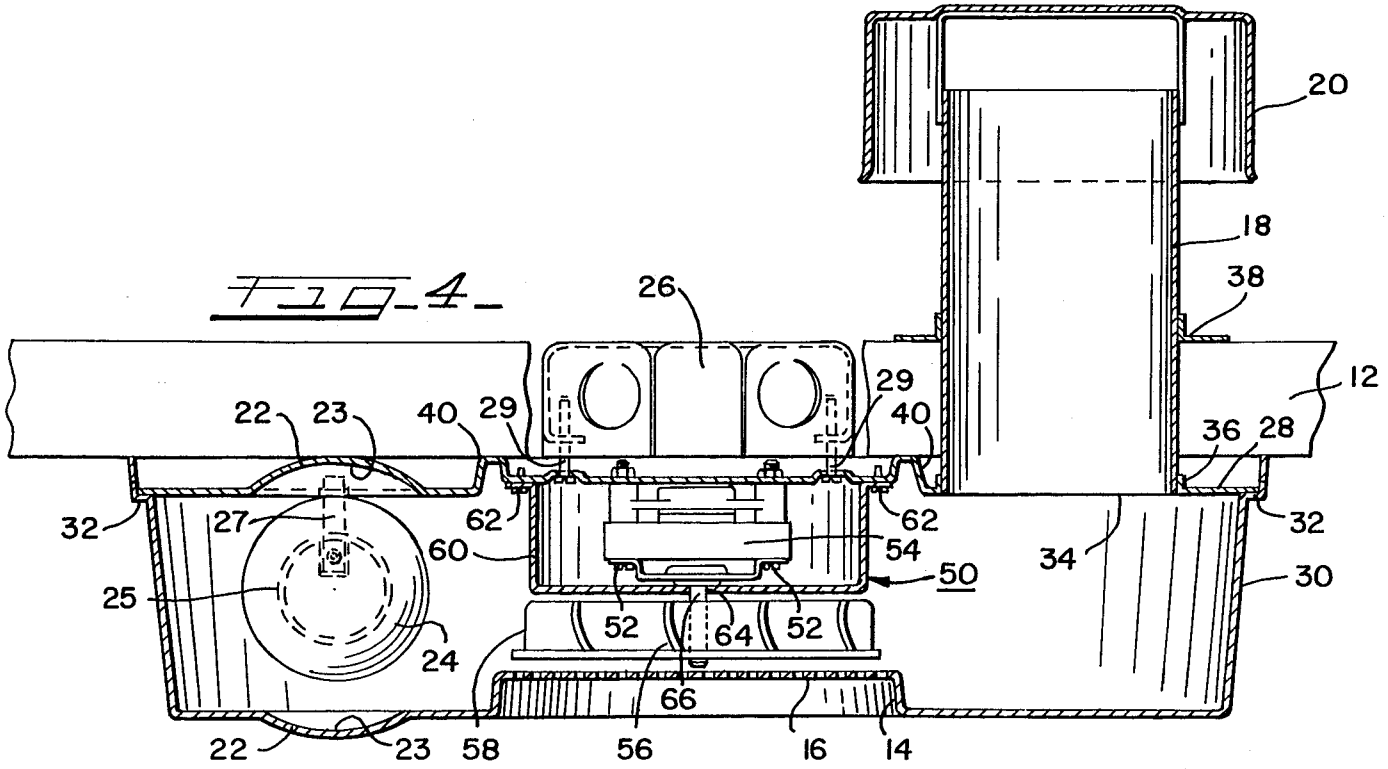
FIG. 4 is a vertical profile view of a ducted, illuminating ventilator mounted to a standard electrical junction box having portions cut away to better illustrate the elements thereof.

Referring now to FIG. 4, there is illustrated one embodiment of the present invention wherein the ducted ventilator is mounted directly to a standard electrical junction box 26 secured to ceiling 12. The ventilator housing is separated into two portions; an upper portion 28 which is secured to the junction box 26 by suitable fastening means, for example, by a pair of threaded screws 29, and a lower portion 30 which is removably secured to the upper portion to allow access to the internal elements of the device. For example, in the embodiment shown, a shoulder 32 is formed in the lower housing portion which is snapped in place on upper housing portion 28, thereby forming an integral housing unit.

An exhaust outlet 34 is formed in the upper housing portion and has a flange 36 formed around the circumference thereof for receiving the end portion of an exhaust duct 18. A protective cap 20 is attached to the external portion of the exhaust duct 18 to prevent moisture, debris and other foreign matter from entering the duct and falling down inside the ventilating unit. An external mounting flange 38 is disposed on the exhaust duct and is secured to the ceiling 12. Flange 38 cooperates with flange 36 formed in the upper housing portion to support and maintain the exhaust duct in position. An outwardly extending supporting member of ring 40 is formed about the center of the upper housing portion. The supporting ring 40 rests against the ceiling or other mounting surface 12 and prevents distortion of the housing as the screws 29 are tightened down.

A fan assembly 50 is mounted to the upper housing portion 28 by any suitable fastening means, for example, in the embodiments shown, by a pair of threaded bolts 52. The fan assembly includes a motor 54, an impeller 56, and a vaneless diffuser 58. Fan motor 54 is enclosed within a fan motor housing 60, which is secured to the internal surface of the upper housing portion 28 by sheet metal screws 62. The fan motor housing 60 protects fan motor 54 from damage which may result from foreign matter being driven against it by the impeller 56 and further includes a hole 64 formed therein for receiving the fan motor output shaft 66, which is operatively connected to the impeller. This arrangement provides additional support for the entire fan assembly 50 and reduces operational vibrations and attendant noise levels.

Referring now to the lefthand portion of FIG. 4, one of the lighting elements in the form of an incandescent bulb 24 is shown inserted into a standard light bulb socket 25. The socket 25 is secured to upper housing portion 28 by a clip bracket 27. Light bulb 24 is positioned between the recess areas 22 formed in the upper and lower housing portions 28, 30, respectively. The recessed areas permit the accommodation of various size bulbs or lighting elements. Internal surface 23 of the recessed areas may be coated with a reflective substance or may be polished to direct or reflect the heat emanating from the bulbs into the internal housing area where it is dissipated by the fan assembly 50 through the exhaust duct 18.

Figure 5:
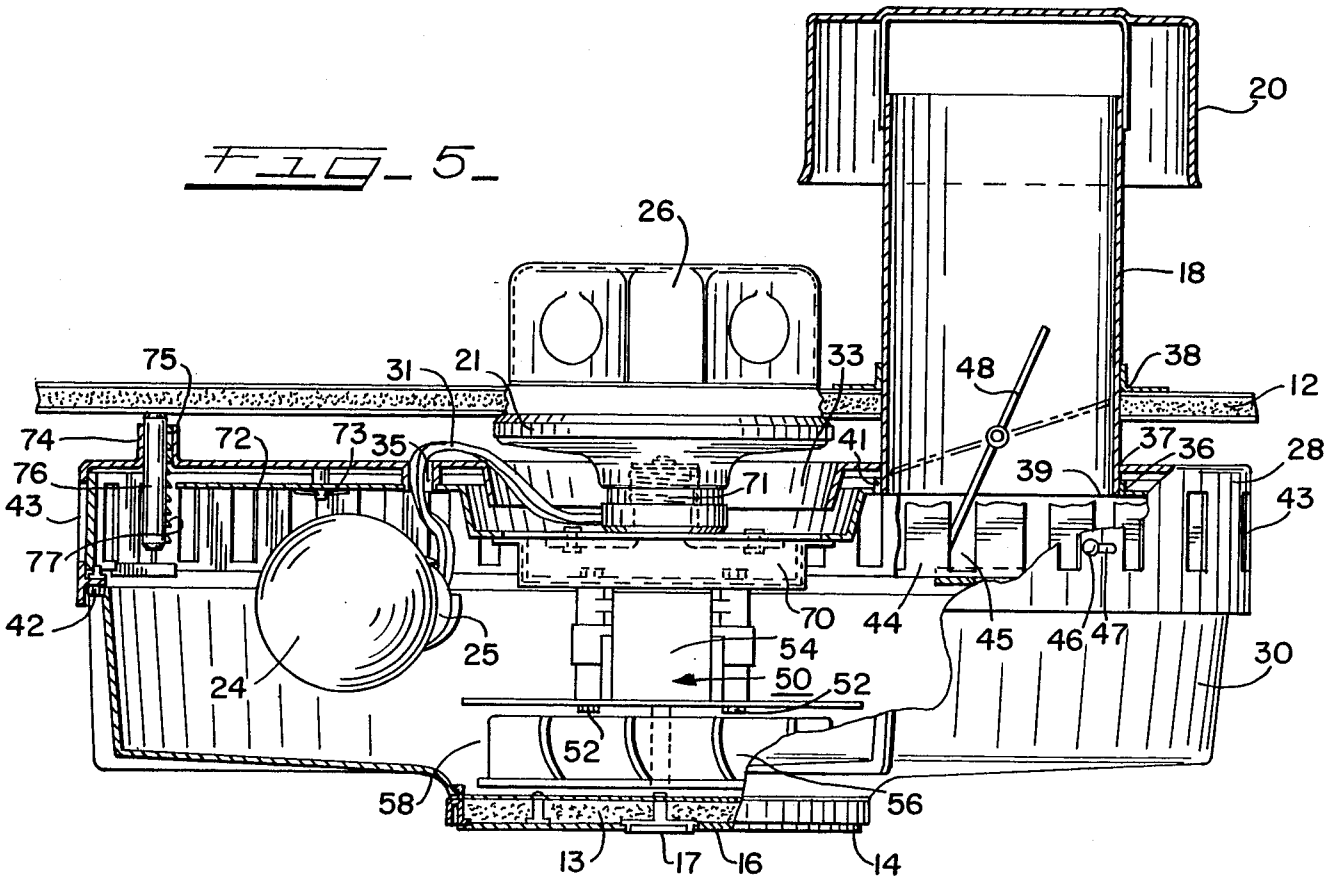
FIG. 5 is a vertical profile view of a surface mounted, ducted, illuminating ventilator mounted to a standard electrical socket having portions cut away to better illustrate the elements thereof.

Referring now to FIG. 5, there are shown the individual elements of an alternate embodiment of the illuminating, ducted ventilator of the invention mounted to a standard ceramic, internally-threaded electrical socket 21. The socket is attached to a ceiling mounted electrical junction box 26 in the customary manner.

An electrical contract assembly 70 is secured to a reflector plate 72 which is mounted to the upper housing portion 28 by an appropriate means such as rivets 73. The contact assembly has a male contact member 71 secured thereto which is removably inserted into the electrical socket 21. Contact assembly 70 delivers electrical energy to the fan assembly 50 and to the light 24 via wires 31. Reflector plate 72 assists in cooling the unit by reflecting the heat from the lighting element 24 downwardly into the interior portion of the housing where it is quickly dissipated by fan assembly 50.

Fan assembly 50 is mounted to the electrical contact assembly 70 by any suitable fastening means such as, for example, by a pair of threaded bolts 52. The fan assembly includes a motor 54, an impeller 56, and a vaneless diffuser 58 as herein described with reference to FIG. 4. For further details concerning a suitable vaneless diffuser fan assembly, reference is made to the present inventor's co-pending application entitled "Mixed Flow Fan with Rotating Vaneless Diffuser", cited previously herein.

An open recess 33 is formed in the upper housing portion 28 to accommodate electrical socket 21, which, for aesthetic reasons, allows the housing to fit closely enough to the ceiling to conceal the socket. An opening 35 also formed in the upper housing portion permits access of wires 31 to a standard light bulb socket 25 adapted to receive light bulb 24 for delivering electrical power thereto. Exhaust outlets 37, 39 are formed in the upper housing portion 28 and reflector plate 72, respectively, and are positioned in vertical alignment for receiving the exhaust duct 18. A flange 41 is formed around the circumference of the exhaust outlet 39 cooperates with a flange 38 secured to the ceiling 12 to hold the duct 18 in place.

A pair of outwardly extending deformable cylinders 74, one of which is shown, are formed in the top surface of the upper housing portion 28. Each cylinder is adapted to receive an adjustable spacer 76 for aligning the unit with the mounting surface 12. The spacers have a plurality of evenly spaced teeth or serrations 77 extending the length thereof for locking engagement with the end surfaces 75 of cylinders 76.

Surface alignment of the ventilating device of the invention is achieved by first inserting male electrical contact member 71 tightly into the socket 21. The relative alignment of the unit with respect to the mounting surface is then determined by visual inspection, and spacer 76 may then be positioned at any desired elevation by squeezing the deformable cylinders 74 to release the teeth 77 and by moving the spacers inwardly or outwardly as necessary. The spacers permit alignment of the device with uneven mounting surfaces and, additionally provide support for the unit if, for example, a pull chain extending from the socket 21 across the top of the housing is used for activation.

Lower housing portion 30 is secured to upper housing portion 28 by a plurality of screws, one of which is shown by the numeral 42 and is readily removable to provide access to the interior elements. A deodorizing or filtering element 13 may be disposed in air inlet 14 formed in the bottom of lower housing portion 30 and is held in place by an inlet grill 16 and a fastener 17. Upper housing 28 is provided with a plurality of apertures 43 of any suitable number and shape circumferentially situated around the housing. A ring 44 is suitably positioned by attachment means adjacent apertures 43 and possesses a plurality of apertures 45 substantially corresponding to apertures 42. Ring 44 is mounted for selective rotation in housing 28 through manipulation of handle 46 in slot 47 to permit apertures 42 to be in alignment with apertures 45 and create fluid communication from the interior of the housing to its surroundings. Alternatively, ring 43 may be shifted to create non-alignment of apertures 43 and 45 to block flow through the housing at apertures 43 or the ring 43 may be situated creating partial blockage for control of the area of the openings. In FIG. 5, apertures 43 are illustrated in a non-aligned relationship with apertures 45 by which upper housing 28 is in the form of an imperforated wall preventing flow therethrough.

Other techniques of achieving selective flow or blockage of flow through upper housing 28, such as slots, vanes, and the like, may also be employed in connection with the invention. The provision for selective control of air flow through the housing 28 can be utilized in cooperation with butterfly valve 48 mounted in duct 18 shown in an open position and in a closed position in phantom in FIG. 5. Valve 48 is selectively moveable from the open position to the closed position to allow the ventilator of the invention to operate in two modes as either a ventilator or an air circulator. It should be apparent to one skilled in the art that the embodiment shown in FIG. 4 can likewise be provided with the foregoing flow control means through housing 28 and duct 18.

Under certain conditions, such as, for example, the presence of excess moisture in the room served by the ventilator of the invention and the like, it is desirable that air drawn into inlet 14 by fan assembly 50 be directly exhausted through duct 18 with valve 48 open and apertures 43 closed through rotation of ring 44 as previously described. In other circumstances, such as, where energy saving is an objective, it is advantageous to prevent the flow of circulated air to the exterior through duct 18 such as to maintain heat or coolness in the room and the like. In this mode of operation, apertures 43 and 45 are aligned, and butterfly valve 18 is closed by which air drawn by fan assembly 50 is circulated back into the room through aligned apertures 43, 45. In either mode of operation, the moving air within the housing also serves to cool and, therefore, prolong the life of the fan motor 54 and the lighting element 24. When a filtering element becomes dirty or clogged or when a deodorizing element is exhausted, it may be easily removed for cleaning or replacement by removing fastener 17 and grill 16.

Figure 7:
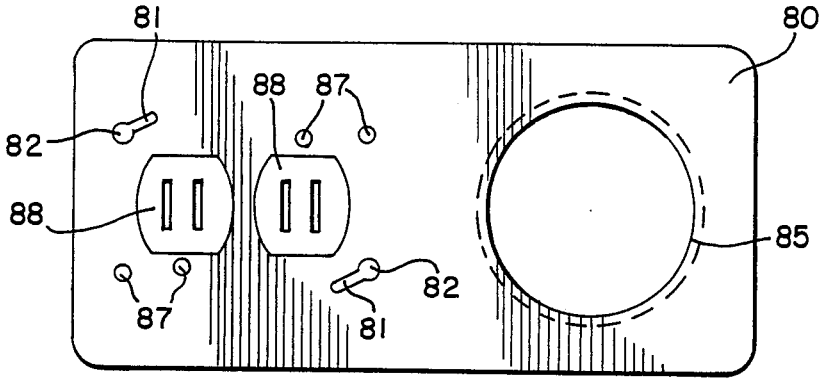
FIG. 7 is a bottom horizontal view of the mounting plate of FIG. 6 taken in a direction of the arrows 7—7 therein.
Figure 6:
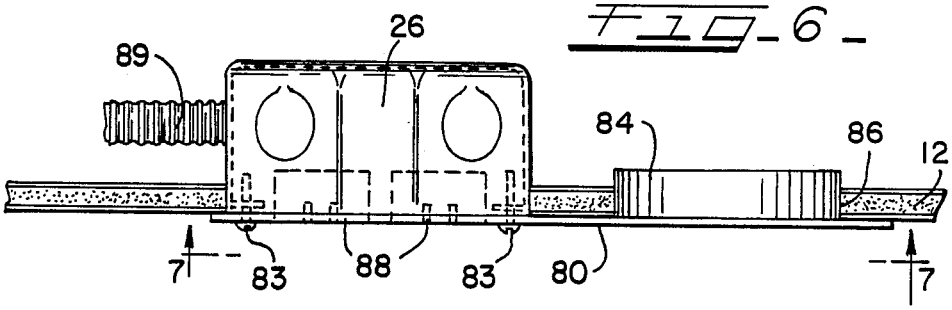
FIG. 6 is a vertical profile view of a mounting plate having plug type electrical sockets secured to a standard electrical junction box.

One form of a mounting plate for mounting a ducted ventilating and air treating unit to a mounting surface is illustrated in FIGS. 6 and 7. The mounting plate 80 may be formed from any suitable material, for example, sheet metal, or alternatively, from an insulating material such as porcelain to prevent the transmission of heat from the ventilator unit to the mounting surface 12.

A pair of slots 81 are formed in the mounting plate having an enlarged end portion 82 for receiving the heads of a pair of mounting screws 83 for securing the plate to the electrical junction box 26. As is well known to those skilled in the art, the mounting screws are first screwed to the electrical junction box. The enlarged ends 82 of the mounting slots 81 are fitted over the ends of the mounting screws. The mounting plate is then rotated in a plane parallel with the mounting surface to align a flange 84 formed about the circumference of an exhaust outlet 85 in the mounting plate 80 and extending outwardly therefrom with the exhaust outlet 86 in the ceiling 12. Thereafter, the screws are tightened down upon the mounting plate securing it in place. A plurality of holes 87 are formed in the plate 80 and are adapted to receive suitable fasteners for securing the ventilating unit thereto.

A pair of standard, female plug-type electrical sockets or receptacles 88 are secured to the mounting plate and connected to an input 89 which delivers electrical power to the junction box. Each of the receptacles 88 is adapted to receive a male electrical plug connected to the separate electrical segments of the ventilator. In this manner, the electrical power is delivered to the fan assembly and the illuminating portions of the ventilator system separately, and permits individual or simultaneous operation thereof. The plug-type electrical connections also facilitate rapid installation or removal of the ducted ventilating and air treating device for replacement or cleaning without the use of any special tools.

Figure 8:
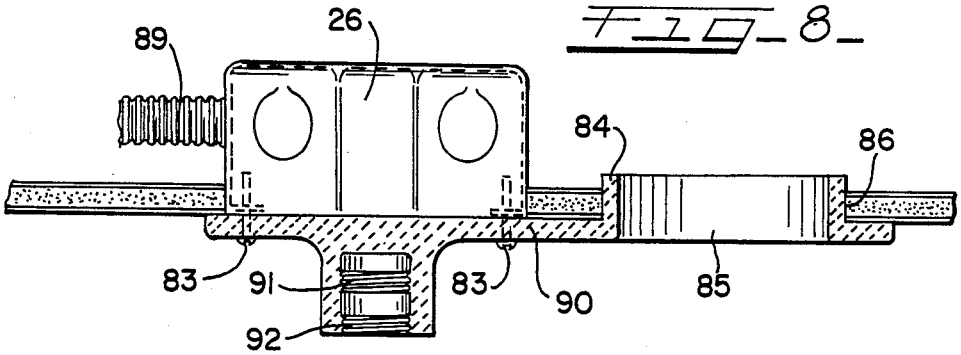
FIG. 8 is a vertical sectional view of a mounting plate having a split electrical socket secured to a standard electrical junction box.

Referring now to FIG. 8, there is shown an alternate embodiment of a mounting plate 90 in the form of a female, threaded electrical socket or receptacle having split and insulated conductive portions 91, 92. The female split socket portion is adapted to receive a corresponding male, threaded split socket portion which is attached to the ventilating and air treating device. The male socket portion performs the dual function of mounting the device to the mounting plate and conducting electrical power to the fan motor and the lighting element. This arrangement also permits separate or simultaneous operation of the fan assembly and the illuminating portions of the ventilator as is hereinbefore discussed in detail. This split electrical socket assembly is the subject of the present inventor's co-pending application, Ser. No. 057,559, entitled "Split Socket Assembly", the elements of which are incorporated herein by reference.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A device for both supplying electrical power to and mounting an air treatment device comprising plate means adapted to be secured to a mounting surface, securement means for securing an air treatment device thereto, said plate means having a contact means adapted to be electrically coupled to a source of electrical power for supplying power to an air treating device, and said plate means further defining a path of fluid communication between the air treatment device and an area external thereto.

2. The apparatus as defined in claim 1 wherein said plate is formed from heat insulative material to prevent transmission of heat from an air treating device to a mounting surface.

3. The apparatus as defined in claim 1 wherein said contact means comprises at least one plug type electrical receptacle.

4. The apparatus as defined in claim 1 wherein said contact means comprises a threaded electrical socket.

5. The apparatus as defined in claim 4 wherein said electrical socket further includes at least two electrically insulated conductive portions.

6. An air ventilator and lamp assembly to be electrically coupled to and suspended from a ceiling electrical socket having an internally threaded electrical contact comprising, a housing having an air inlet and an air outlet with a path of air flow defined therebetween, an externally threaded electrical contact fixedly secured on an outer portion of said housing and directly engagable into a ceiling mounted electrical socket having an internally threaded electrical contact for coupling a source of electrical power to within said housing, said externally threaded electrical contact fixedly secured on the outer portion of said housing to directly engage the internally threaded electrical contact forming an electrical contact for coupling a source of electrical power to within said housing and a support for physically connecting said housing directly to the internally threaded electrical socket when threadingly engaged therewith, air circulating means carried by said housing for drawing air thereinto through said air inlet and discharging the air drawing thereinto out through said air outlet, said air circulating means being electrically coupled to said externally threaded electrical contact fixedly secured on an outer portion of said housing, illuminating means carried by said housing and actuable to emit light therefrom, said illuminating means being electrically coupled to said externally threaded electrical contact and positioned in thermal contact with said path of air flow to dissipate heat generated upon the actuation thereof, and duct means coupled to said air outlet defining a flow passage from said housing for exhausting the air to an area removed from the housing.

7. The air ventilator and lamp assembly as defined in claim 6 wherein said air circulating means comprises a vaneless diffuser.

8. The air ventilator and lamp assembly as defined in claim 6 further including:

air treating means removably disposed in said air flow path.

9. The air ventilator and lamp assembly as defined in claim 6 wherein said housing further includes a grill member mounted at said air inlet.

10. The air ventilator and lamp assembly of claim 6 wherein said air inlet is formed in the bottom of the housing.

11. The air ventilator and lamp assembly of claim 6 wherein said air outlet is formed at the top of the housing.

12. The air ventilator and lamp assembly of claim 6 wherein said duct means includes valve means selectively moveable from an open position to a closed position.

13. The air ventilator and lamp assembly of claim 12 wherein said housing further includes means forming apertures selectively operative to create an additional air flow outlet therefrom or to block said additional air flow outlet.

14. An air ventilator and lamp assembly to be electrically coupled to and suspended from a ceiling electrical socket having an internally threaded electrical contact comprising, a housing having an air inlet and an air outlet with a path of air flow defined therebetween, an externally threaded electrical contact carried on an outer portion of said housing and engagable into a ceiling mounted electrical socket having an internally threaded electrical contact for coupling a source of electrical power to within said housing, said externally threaded electrical contact carried on the outer portion of said housing to engage the internally threaded electrical contact comprising a support for suspending said housing from the electrical socket when threadingly engaged therewith, said externally threaded electrical contact carried on an outer portion of said housing and engagable with a ceiling mounted electrical socket having an internally threaded contact for coupling a source of electrical power to within said housing including at least two coaxial electrically conductive contact portions electrically insulated one from the other and a third common electrical contact operatively coupled to each one of said at least two coaxial electrically insulated conductive contact portions for completing separate electrical circuits for said circulation means to said illuminating means, air circulating means carried by said housing for drawing air thereinto through said air inlet and discharging the air drawn thereinto out through said air outlet, said air circulating means being electrically coupled to said externally threaded electrical contact carried on an outer portion of said housing, illuminating means carried by said housing and actuable to emit light therefrom, said illuminating means being electrically coupled to said externally threaded electrical contact and positioned in thermal contact with said path of air flow to dissipate heat generated upon the actuation thereof, and duct means coupled to said air outlet defining a flow passage from said housing for exhausting the air to an area removed from the housing.

15. The air ventilator and lamp assembly as defined in claim 14 further including an internally threaded electrical socket assembly comprising, at least two internally threaded electrically conductive contact portions electrically insulated one from the other, said electrically conductive contact portions which are electrically insulated one from the other being coaxially positioned and having substantially the same diameter and thread pitch for engaging said at least two externally threaded electrically conductive contact portions electrically insulated one from the other, and a third common electrical contact operatively coupled to each one of said at least two internally threaded electrically insulated conductive contact portions and electrically coupled to said third common electrical contact operatively coupled to each one of said at least two externally threaded electrically insulated conductive contact portions.

* * * * *